US005248034A

United States Patent [19]

Janhonen

[11] Patent Number: 5,248,034

[45] Date of Patent: Sep. 28, 1993

[54] BOOK PACKAGE BLANK AND METHOD AND MACHINE FOR ITS FABRICATION

[75] Inventor: Tarmo Janhonen, Vantaa, Finland

[73] Assignee: Pussikeskus Oy, Helsinki, Finland

[21] Appl. No.: 875,658

[22] Filed: Apr. 29, 1992

[30] Foreign Application Priority Data

May 8, 1991 [FI] Finland ..... 912117

[51] Int. Cl.[5] ..... B65D 75/02

[52] U.S. Cl. ..... 206/424; 206/491

[58] Field of Search ..... 206/424, 491, 492

[56] References Cited

U.S. PATENT DOCUMENTS

| | | | |
|---|---|---|---|
| 2,011,703 | 8/1935 | Barker . | |
| 2,071,232 | 2/1937 | Langehennig . | |
| 3,217,868 | 11/1965 | Champlin et al. . | |
| 3,253,379 | 5/1966 | Foradora . | |
| 3,713,577 | 1/1973 | Skinner | 206/424 |
| 3,834,610 | 9/1974 | Eifrid | 206/424 |
| 3,986,657 | 10/1976 | Angelini . | |
| 4,322,028 | 3/1982 | Kawahara . | |
| 4,325,507 | 4/1982 | Janhonen . | |
| 4,589,552 | 5/1986 | Chevalier . | |
| 4,624,407 | 11/1986 | Janhonen . | |
| 4,627,223 | 12/1986 | Janhonen . | |
| 4,674,129 | 6/1987 | Janhonen . | |
| 4,757,666 | 7/1988 | Janhonen . | |
| 4,956,961 | 9/1990 | Janhonen . | |
| 4,972,653 | 11/1990 | Janhonen . | |

FOREIGN PATENT DOCUMENTS

| | | | |
|---|---|---|---|
| 1131534 | 7/1979 | Canada . | |
| 377375 | 7/1990 | European Pat. Off. | 206/424 |
| 2719288 | 11/1977 | Fed. Rep. of Germany | 206/424 |
| 2307707 | 12/1969 | France . | |
| 2311729 | 11/1971 | France . | |
| 2297785 | 11/1975 | France . | |
| 2591998 | 6/1987 | France | 206/424 |
| 8302764 | 8/1983 | PCT Int'l Appl. . | |
| 1345163 | 1/1974 | United Kingdom | 206/424 |

OTHER PUBLICATIONS

U.S. patent application Ser. No. 07/506,422 filed Apr. 9, 1990 by inventor Veikko I. Janhonen discloses a method for packaging books.

*Primary Examiner*—William I. Price

*Attorney, Agent, or Firm*—Price, Heneveld, Cooper, DeWitt & Litton

[57] ABSTRACT

A book package blank and method and machine for its fabrication by a continuous process. A cardboard web (2) of thin and solid pulp is pulled from a reel. The web is gently corrugated between splined rollers (4) to guide the folding of the cardboard around one or more books. The final separated blank is a rectangular sheet of double layered cardboard having bending lines along its two opposite edges between the two superimposed layers. The layers are attached to each other with the exception of two opposite flaps (17) defined by slits (16) in the topmost layer and detached from the bottom cardboard layer, the width of the flaps corresponding to that of the book(s).

11 Claims, 2 Drawing Sheets

BOOK PACKAGE BLANK AND METHOD AND MACHINE FOR ITS FABRICATION

The invention relates to a book package blank, and also to a method and a machine for the fabrication of such a package blank.

It is prior known to make this type of book package blank from a strip of corrugated cardboard by gluing on top of each other two sheet or strip layers, the top layer sheets being provided with transverse slits for separating flaps, which are used for binding a book and not glued fast to the base layer. U.S. Pat. No. 4,589,552 also discloses a similar package strip which is cut to a precisely measured rectangle prior to cutting and folding operations associated with the fabrication of a package strip. However, the use of corrugated cardboard as raw material for a package blank involves several drawbacks. Corrugated cardboard is a bulky and relatively expensive material as well as inconvenient in terms of providing a continuous package-blank fabrication process. In addition, a package blank made of corrugated cardboard is poorly adapted to mechanical closing of a package as corrugated cardboard is a stiff and thick material and has a poor resistance to local surface pressure. A particular drawback in this prior known package, as well as in a package known from U.S. Pat. No. 4,589,552, is that, if the base gluing of a flap used for binding a book fails, the end of a package opens and the book can be damaged or slip out of the package.

An object of the invention is to provide a package blank, whose manufacturing material is selected and pretreated during the course of a fabrication process so as to produce a relatively inexpensive package blank of minimum bulk, which can be fabricated by a continuous-action process and which, as a finished package, offers good protection for a book to be wrapped without said hazard of accidental opening of the ends.

This object is achieved by means of a book package blank of the invention, which is characterized in that (a) the superimposed cardboard layers are made of a single sheet by folding in a manner that the folding lines delimit the side edges of a blank, (b) that the cardboard throughout its thickness comprises compact solid pulp having a thickness of appr. 0,2–0,8 mm and a weight by unit area of appr. 200–600 g/m$^2$, and (c) the cardboard material is pre-folded in a direction perpendicular to the blank side edges to form gentle corrugations at small distances from each other, which corrugations do not substantially weaken the normal rigidity of cardboard but, upon folding the cardboard, effect the folding of cardboard to occur along the folding lines parallel to said corrugations.

In a continuous-action fabrication process, it is possible to pull relatively thin solid-pulp cardboard in large quantities continuously from a single supply roll with a sufficiently long interval between roll replacements in view of continuous production.

The pre-foldings made in cardboard during the course of a fabrication process are of essential significance regarding the closeability of a package and the appearance of a finished package. Folding around an article is effected easily and neatly along adjacent, straight folding lines instead of cracking along divergent and discontinuous folding lines, which would be the case with such solid cardboard without said pre-foldings. However, the pre-foldings must not be scores or grooves, obtained by compressing the cardboard material and generally used for making pre-folding lines in cardboard since, in this case, a blank would lose its stiffness which is necessary in the handling of a blank both prior to and during a packaging operation. For example, during the course of packaging or wrapping the bending stiffness is required in order to secure the cardboard tightly around an article to be wrapped. This will also facilitate the mechanical closing of a package. The mechanical closing of a package blank to create a finished package can be effected e.g. by using machines disclosed in U.S. Pat. Nos. 4,757,666 and 4,972,653, even though these have actually been developed for slightly different types of packages.

The invention will now be described in more detail with reference made to the accompanying drawings, in which FIG. 1 shows a package-blank fabricating machine schematically in a side view while illustrating the various operations included in a fabrication method;

Figure 3:
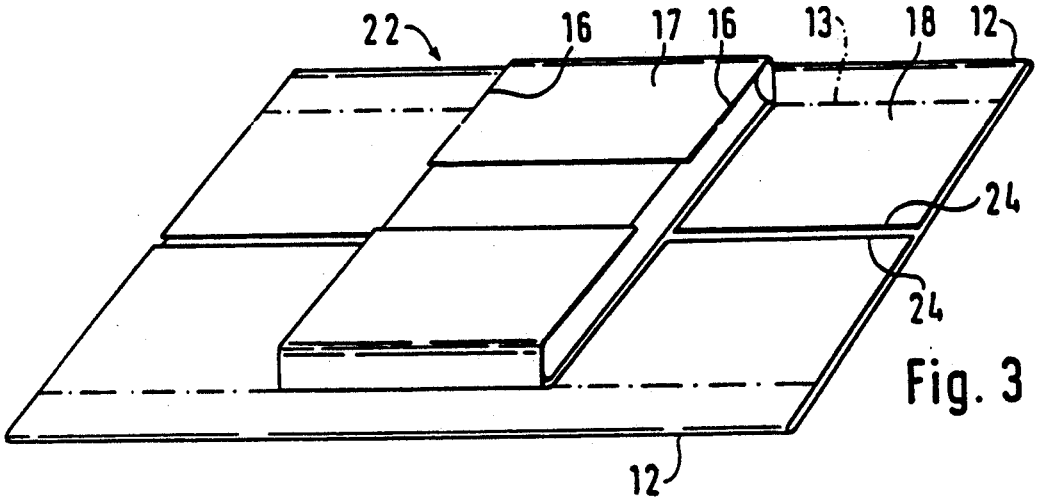
FIG. 3 shows a package blank of the invention with a book to be wrapped placed thereon prior to closing the package.

FIG. 3 illustrates a book-package blank, comprising a single sheet or strip which is folded into two superimposed cardboard layers over the entire blank area. Folding lines 12 define the blank side edges and edges 24 of the original unfolded sheet are located within the central blank area in parallel relationship with side edges 12. Between edges 12 and 24 the upper cardboard layer is provided with slits 16, extending perpendicularly to said edges and being spaced from each other a distance corresponding to the width of a book to be wrapped and terminating at a small distance from blank side edges 12. The object is to provide the ends of a finished package in a prior known manner with insets in order to prevent the corners of a book from ending up in the corners of a finished package. The superimposed cardboard layers are attached to each other over end sections 18 and also over the sections lying between a dash-and-dot line 13 and outer edge 12. The cardboard layers are detached from each other over sections 17, located between slits 16 and creating the flaps to be folded over the ends of a book being wrapped. The outer surfaces of flaps 17 can be coated with an adhesive or provided with an adhesive covered by a protective paper, the end sections 18 adhering to said adhesive upon closing the package by folding said blank end sections 18 around the long edges of a book. Thus, flaps 17 retain a book in the package without a binding strip closing the package ends.

The package blank is made of cardboard, comprising compact solid pulp throughout its thickness. The cardboard thickness is appr. 0,2–0,8 mm, preferably 0,2–0,6 mm, most conveniently appr. 0,3–0,5 mm. The cardboard has a weight by unit area of appr. 200–600 g/m$^2$, preferably appr. 200–500 g/m$^2$. One surface of the cardboard can be coated with paper which improves the surface quality and appearance of a finished package.

Figure 1:
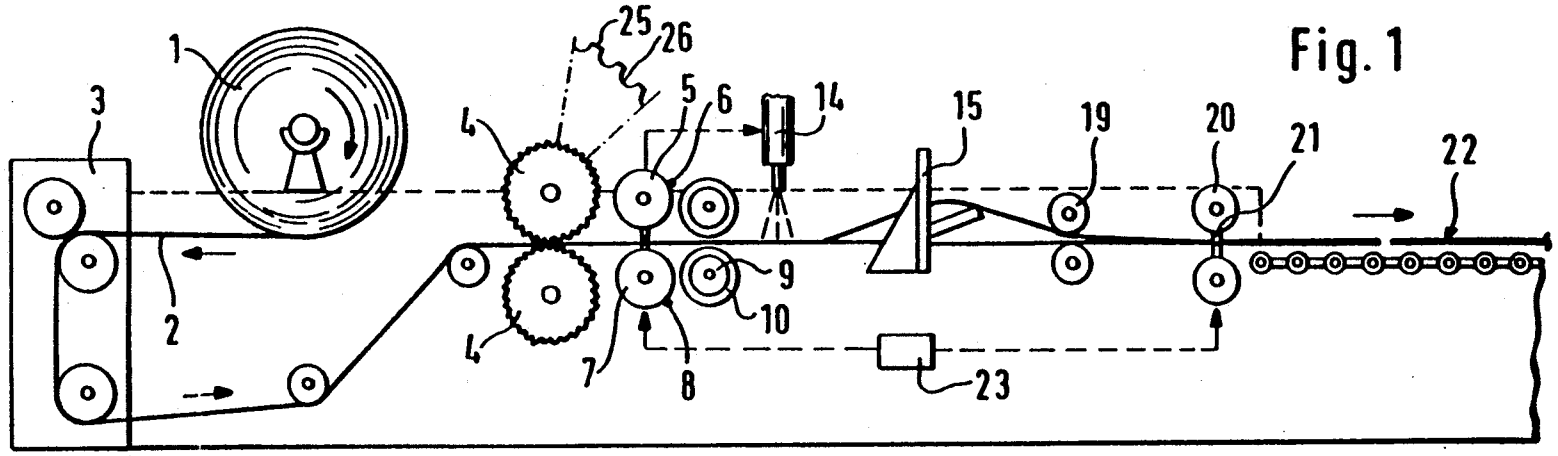
Figure 2:
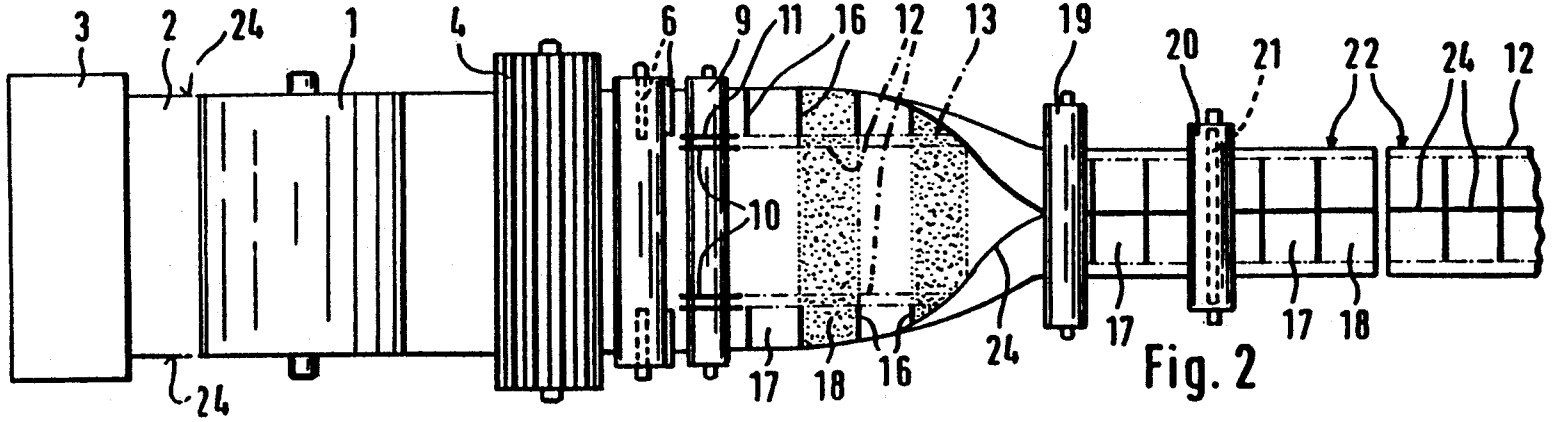
FIG. 2 shows schematically the machine of FIG. 1 in a plan view.
Figure 4:
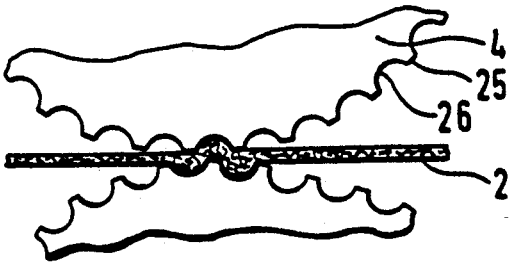
FIG. 4 shows a detail of the packaging machine in a larger scale.
Figure 5:
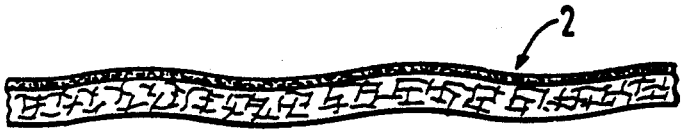
FIG. 5 shows in an enlarged scale a cross-section through the cardboard material for a package blank.

The fabrication method and machine will now be described with reference made to FIGS. 1 and 2. The fabrication involves the use of a cardboard web or strip 2, pulled out of a roll 1 and having a width that corresponds to the double width of a blank 22 to be fabricated. If necessary, the cardboard web 2 is passed through a printing unit 3 for printing desired images and/or text on the surface of cardboard or paper attached thereto. At the next stage, said web 2 is passed through splined rollers 4. As shown in more detail in FIGS. 4 and 5, the meshing grooves 26 and ridges 25 of rollers 4 produce gentle waves or corrugations in cardboard web 2. The distance between rollers 4 is adjusted such that ridges 25 do not apply a strong compression to cardboard against the bottoms of grooves 26 of the other roller 4, whereby the cardboard will be slightly corrugated but does not lose, at least not essentially, its inherent normal rigidity. However, upon folding the cardboard (around the long sides of a book in FIG. 3), the corrugations urge the cardboard to fold along folding lines parallel to said corrugations, the package thus obtaining a neat appearance also within the area of the folded long side edges.

At the next stage, said web 2 runs through a pair of rollers 5, 7. Each end of roller 5 is fitted with two blades 6 whose circumferential spacing or gap matches the distance between cutting slits 16 and axial length matches the desired length of slits 16. Roller 7 is provided with counter-blades 8, comprising e.g. the edges of take-up recesses for blades 6.

The web 2 passes next through scoring rollers 9 provided with annular bosses 10, the cardboard being compressed therebetween to form folding scores 12. Thus, the axial distance between scoring rings 10 determines the width of a package blank, which is approximately half of the width of the original web 2. The distance between rings 10 must be slightly less than the axial distance between the mutually closest edges of cutting blades 6 in order to provide the above-mentioned inset.

Rollers 9 can be provided with second scoring rings 11, which are located in alignment with the ends of slits 16 and which impress the cardboard to form scoring lines 13 for facilitating the folding of flaps 17. However, the scoring lines 13 are not absolutely necessary.

Adhesive nozzles 14 are used to apply adhesive periodically, so that the areas between slits 16 remain free of adhesive. The periodic operation of nozzles 14 can be controlled e.g. in synchronization with the rotation of roller 5.

Suitably designed edge guides 15 are used to bend both edges of web 2 along folding scores 12 to bring the web edge sections in a doubled fashion on top of the central area. Press rolls 19 are used to press superimposed cardboard layers against each other. Finally, a rotating roller 20, by means of its crosswise cutting blade 21, cuts the double-layered web into finished package blanks 22. The operation of roller 20 must naturally be synchronized with that of pair of rollers 5, 7. This can be effected either by means of a common drive control 23 or by mechanically coupling together the drive of said rollers.

Figure 6:
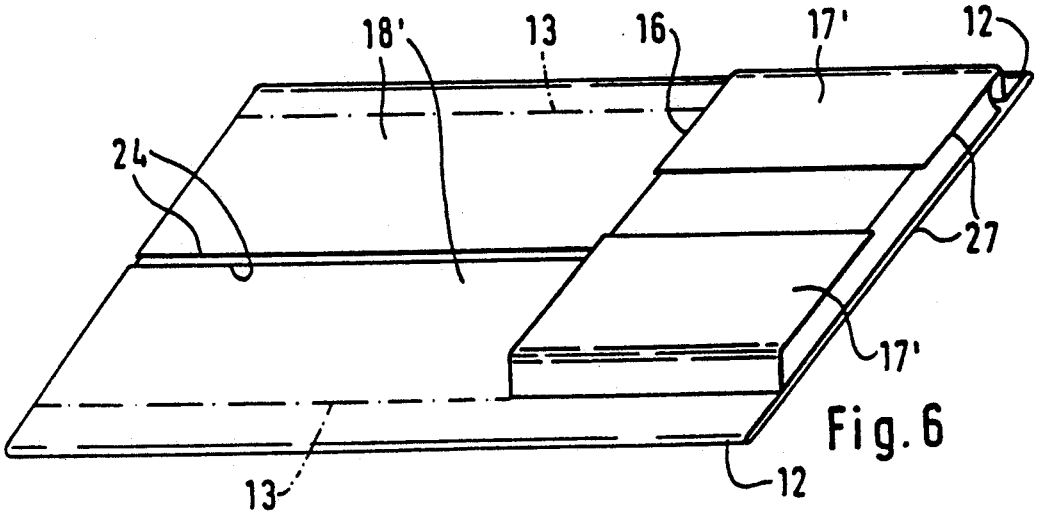
FIG. 6 is a view similar to FIG. 3 showing a package blank according to a second embodiment of the invention.

A package blank as shown in FIG. 6 only differs from FIG. 3 in that a book to be wrapped will be placed underneath flaps 17' defined at a blank end section 27 (instead of being placed in the middle of a blank). Thus, a double-layered blank section 18', extending over the central area to the other blank end, will be wrapped around both of the narrow long sides of a book. Also in this case it is essential that the flaps 17' be made of the same continuous cardboard sheet as the rest of the package whereby, in case the base gluing of flap 17' should fail, said flap 17' is nevertheless unable to get loose and the book cannot slip out of the package.

When manufacturing a package blank as shown in FIG. 6, the fabrication method and machines only differ from those described above in that both edges of web 2 are only provided with a single slit 16, which will be located at a distance substantially equal to the width of a book to be wrapped from the other blank end 27. Thus, the area between slits 16 and end 27 is not coated with adhesive in order to form flaps 17'. Hence, each end of roller 5 is only provided with a single blade 6 and the rotation of roller 5 is synchronized with that of cutting roller 20 for providing a desired width for flap 17' between slit 16 and end cutting 27.

The distance between the parallel tops of corrugations, corresponding to the spacing of ridges 25, is approximately 5–10 mm, preferably appr. 6–7 mm. A very short wave or corrugation is technically difficult to produce and too long a distance between corrugations no longer coincides with necessary folding points but would result in uncontrolled bending also between the corrugations.

One and the same blank can of course be applied to wrap even a plurality of books, the overall thickness of a book or books being only limited by the requirement that flaps 17, 17' and sections 18, 18' must extend to a sufficient extent on top of the wide side or wide sides of a book.

I claim:

1. A book package blank, comprising a flat, rectangular sheet of cardboard including two superimposed cardboard layers over substantially the entire blank area, the upper cardboard layer comprising two peripheral flaps whose edges (24) lie within the central area of a blank in the parallel relationship with blank side edges (12), in addition to which said peripheral flaps are provided between their edges (24) and blank side edges (12) with slits (16) which are perpendicular to said edges (12, 24) and terminate at a slight distance from blank side edges (12), the superimposed cardboard layers being attached to each other with the exception of flaps (17) defined by slits (16) and detached from the bottom cardboard layer, characterized in that (a) the superimposed cardboard layers are made of a single sheet by folding in a manner that folding lines (12) define the side edges of a blank, (b) that the cardboard throughout its thickness comprises compact solid pulp having a thickness of approximately 0,2–0,8 mm and a weight by unit area of approximately 200–600 g/m$^2$, and (c) that the cardboard material is pre-folded in a direction perpendicular to blank side edges (12) to form gentle corrugations at small distances from each other, which corrugations do not substantially weaken the normal rigidity of cardboard but, upon folding the cardboard, urge the folding of cardboard to occur along folding lines parallel to said corrugations.

2. A book package blank as set forth in claim 1, characterized in that the cardboard has a thickness of appr. 0,2–0,6 mm, and a weight by unit area of approximately 250–500 g/m$^2$.

3. A book package blank as set forth in claim 2 characterized in that the cardboard has a thickness of approximately 0.3–0.5 mm.

4. A book package blank comprising:

a flat, rectangular sheet of cardboard having a main panel and opposing side panels, said side panels including first edges opposite said main panel, said side panels being folded and superimposed onto said main panel with said first edges positioned adjacently on said main panel, said side panels and said main panel defining folded edges connecting same; and opposing flaps defined in each of said side panels by said first edges and also by one or more slits extending from said first edges toward said folded edges but terminating a distance short thereof, said side panels being adhered to said main panel in areas other than said opposing flaps so that said flaps can be folded away from said main panel to hold a book being packaged between said flaps and said main panel, said flaps each forming an edge portion extending away from said main panel to seat against the adjacent edges of the book being packaged, the remaining portions of said flaps being folded against the face of the book opposite from that seated on said main panel.

5. A book package blank as defined in claim 4 wherein said cardboard is pre-folded in a direction perpendicular to said folded edges to form gentle undulations in close proximity to each other, said undulations being sufficiently gentle to maintain the normal rigidity of said cardboard but, upon folding said cardboard, urging the folding of said cardboard to occur along folding lines parallel to said undulations.

6. A book package blank as defined in claim 5 wherein said one or more slits includes at least two parallel slits of equal length on each of said side panels, said parallel slits defining part of said flaps, said flaps being located centrally on each of said side panels.

7. A book package blank as defined in claim 6 wherein said cardboard has a thickness of about 0.2 to 0.8 mm and a weight of about 200 to 600 g/m$^2$.

8. A book package blank as defined in claim 4 wherein said cardboard has a thickness of about 0.3 to 0.5 mm and a weight of about 250 to 500 g/m$^2$.

9. A book package blank comprising:

a flat rectangular sheet of cardboard;

a plurality of slits formed into said sheet to form a central panel having a pair of edge panels integral therewith along a pair of opposing sides;

a pair of slit-like openings in each of said edge panels extending from adjacent the juncture of said edge panels to said central panel to the adjacent edge of said sheet, said openings forming each of said edge panels into three parallel portions, the center portion of each of which is free to be folded over a book placed on said sheet in alignment with said center panels;

said edge panels on each side of said center panel being foldable over said center panels to encase said center panels and any book over which they are wrapped to form a package encasing the book.

10. A book package blank as described in claim 9 wherein said sheet is pressed to form parallel undulation therein extending parallel of said slit-like openings to facilitate folding of said edge panels over said center panels.

11. A book package blank as described in claim 10 wherein said slit-like openings terminate short of said central panel to define protective strips that extend along the central panel and that extend outwardly from the book encased in the center panels, said protective strips being adapted to protect the ends of the book.

* * * * *